United States Patent [19]

Inose et al.

[11] 4,026,403

[45] May 31, 1977

[54] AUTOMATIC PRINTER WITH PLURALITY OF REPLACEABLE PRINTING MEMBERS

[75] Inventors: Fumiyuki Inose, San Jose; Akio Komatsu, Cupertino, both of Calif.

[73] Assignee: Hitachi, Ltd., Tokyo, Japan

[22] Filed: Feb. 12, 1976

[21] Appl. No.: 657,608

[30] Foreign Application Priority Data

Feb. 14, 1975 Japan ..... 50-17930

[52] U.S. Cl. ..... 197/53; 197/1 A; 197/18

[51] Int. Cl.[2] ..... B41J 1/30

[58] Field of Search ..... 197/1 A, 16, 18, 19, 197/20, 48, 49, 53–55; 101/93.15–93.19, 382 MV; 29/568; 340/172.5; 214/1 BS; 51/362

[56] References Cited

UNITED STATES PATENTS

| | | | |
|---|---|---|---|
| 2,503,162 | 4/1950 | Lundgren | 197/36 |
| 2,620,731 | 12/1952 | Slonneger | 101/382 MV |
| 2,996,004 | 8/1961 | Sinkiewicz | 101/405 X |
| 3,432,018 | 3/1969 | Watanabe et al. | 197/55 X |
| 3,620,344 | 11/1971 | Clancy et al. | 197/52 X |
| 3,645,372 | 2/1972 | Noell et al. | 197/18 |
| 3,707,214 | 12/1972 | Ponzano | 197/18 X |
| 3,878,929 | 4/1975 | Orlens et al. | 197/18 X |
| 3,892,303 | 7/1975 | Willcox | 197/18 |

*Primary Examiner*—Edgar S. Burr
*Assistant Examiner*—Paul T. Sewell
*Attorney, Agent, or Firm*—Jackson & Jones

[57] ABSTRACT

An automatic printer assembly capable of printing a large number of characters from a plurality of replaceable printing members and valuable in printing characters in a foreign language, such as Japanese Kanji, and the like. The printing member support carriage can align with a storage device, such as a carousel holder, to exchange printing members. A character memory storage receives an appropriately coded signal indicating a predetermined amount and location of characters that are to be printed on a predetermined area of a medium. A controller addresses the memory storage to select the appropriate character printing member. The input character information can be appropriately coded to minimize the scan time of the printing members by a sequential selecting of the printing members based on the respective character use of each printing member. The controller controls the position of the paper, the carriage, and the striking of a hammer so that the characters on the printing member are coordinately printed as a first group across the predetermined area of the medium. The controller can then sequentially activate the exchange device to replace the first character member with a second character printing member for rescanning the same predetermined area of the medium to interpolate the printing of a second group of characters. Subsequent printing members can be utilized in a similar fashion until all the stored characters are printed out.

15 Claims, 16 Drawing Figures

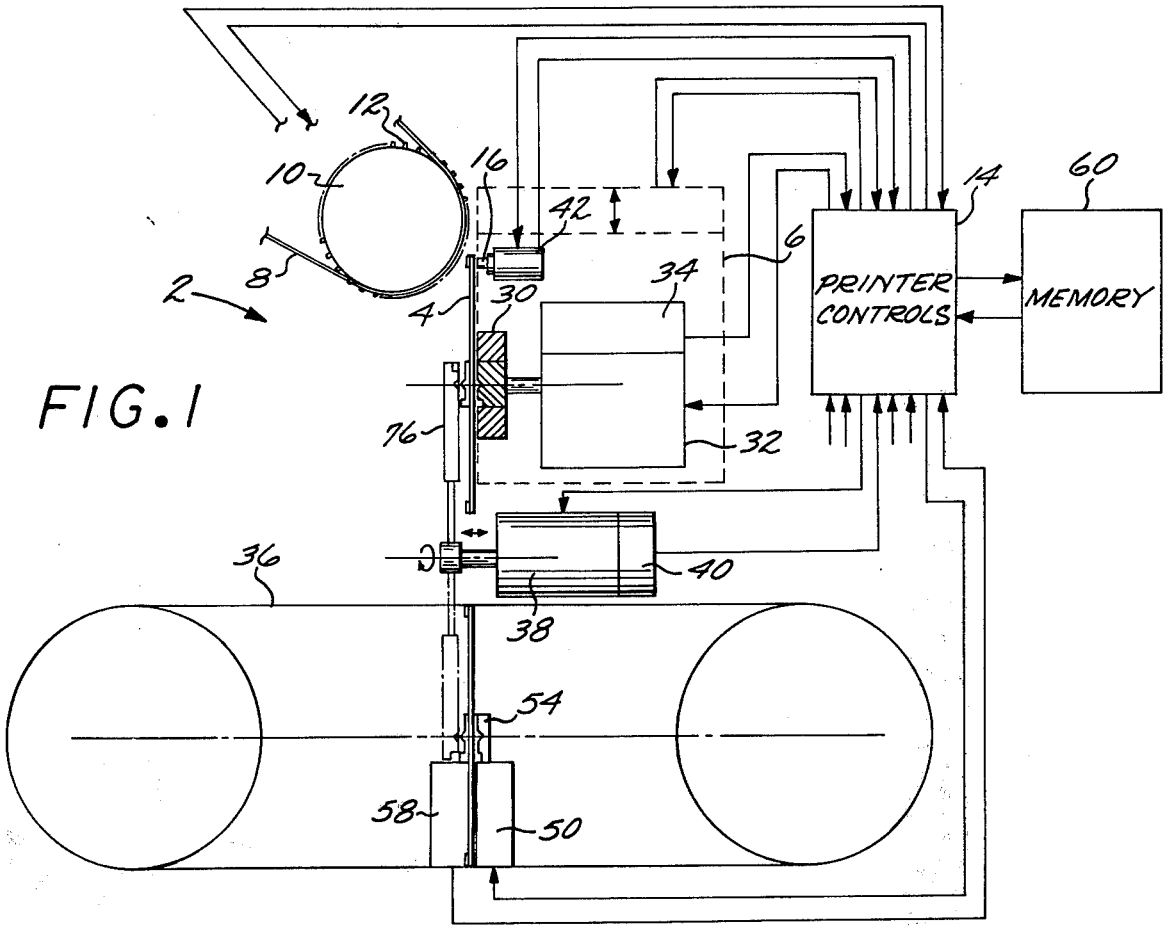
FIG. 1
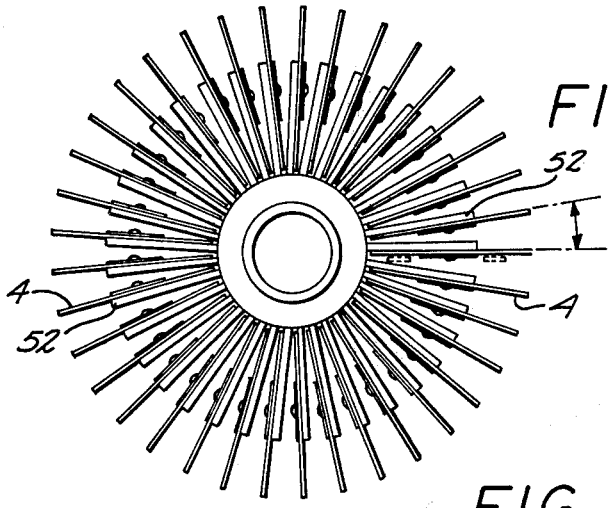
FIG. 2
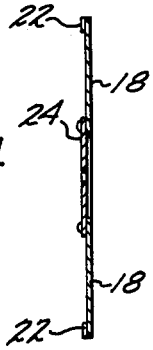
FIG. 4
FIG. 5
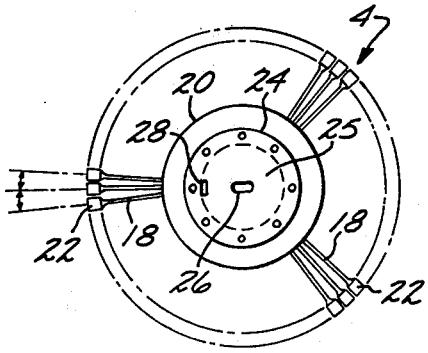
FIG. 3
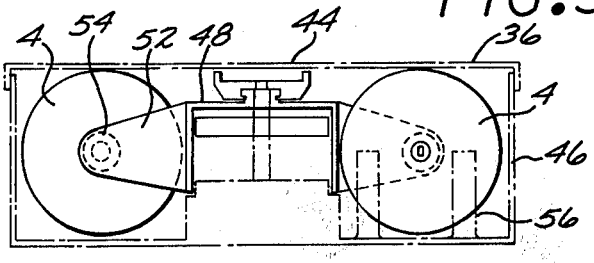

FIG. 10
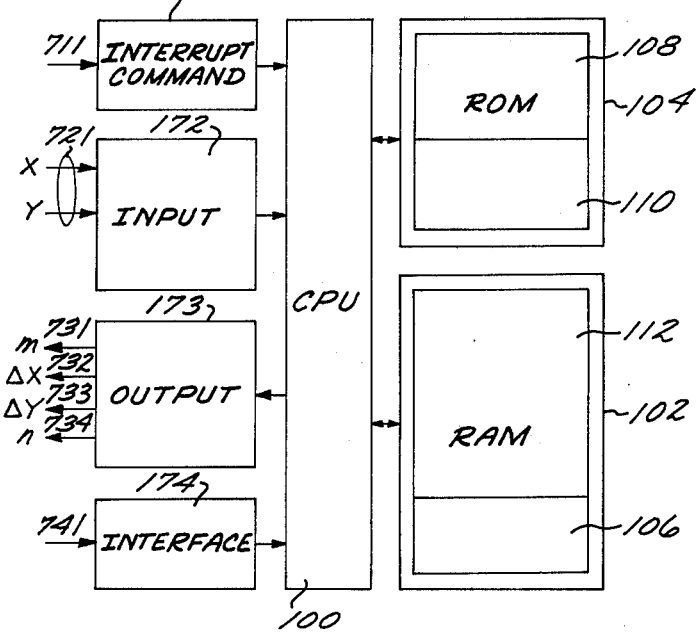
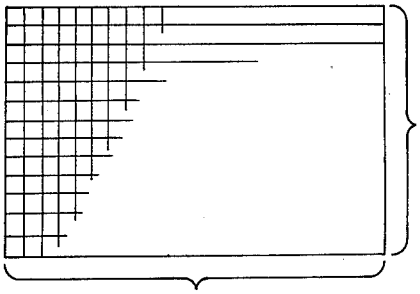
FIG. 11
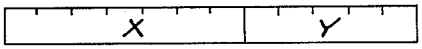
FIG. 12
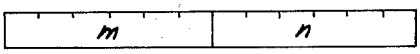
FIG. 13
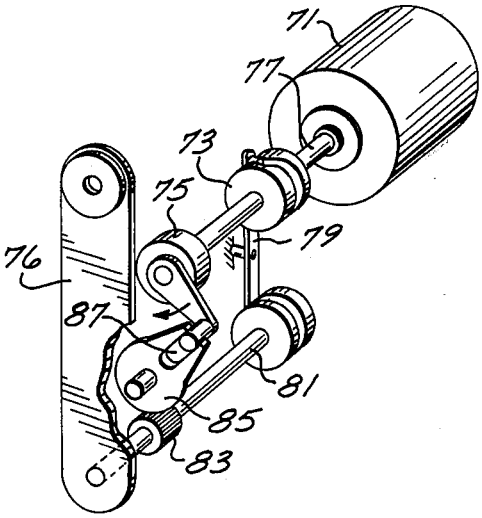
FIG. 15
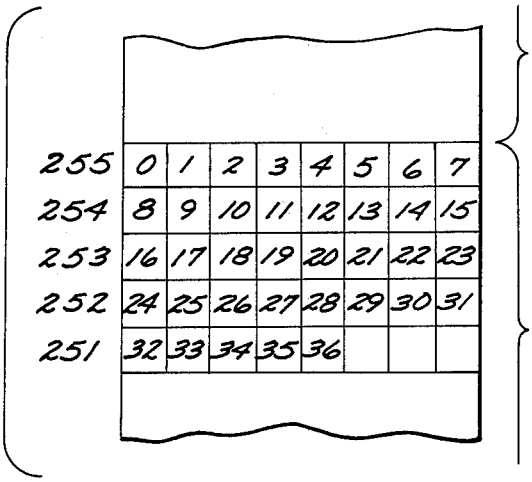
FIG. 14

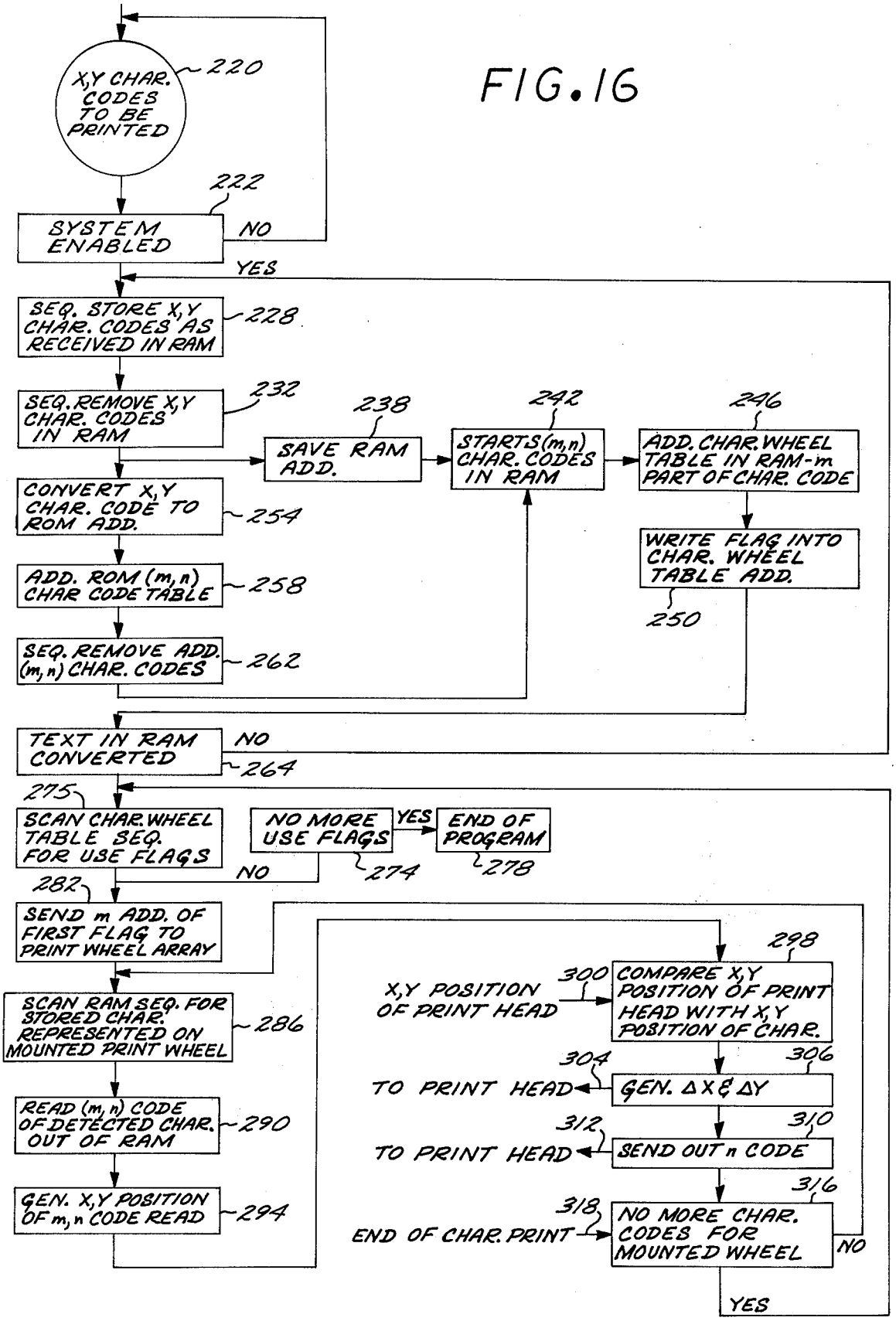
FIG. 16
X,Y CHAR. CODES TO BE PRINTED
220
222
SYSTEM ENABLED
NO
YES
SEQ. STORE X,Y CHAR. CODES AS RECEIVED IN RAM
228
SEQ. REMOVE X,Y CHAR. CODES IN RAM
232
238
SAVE RAM ADD.
242
STARTS (m,n) CHAR. CODES IN RAM
246
ADD. CHAR. WHEEL TABLE IN RAM-m PART OF CHAR. CODE
WRITE FLAG INTO CHAR. WHEEL TABLE ADD.
250
CONVERT X,Y CHAR. CODE TO ROM ADD.
254
ADD. ROM (m,n) CHAR CODE TABLE
258
SEQ. REMOVE ADD. (m,n) CHAR. CODES
262
TEXT IN RAM CONVERTED
NO
264
275
SCAN CHAR. WHEEL TABLE SEQ. FOR USE FLAGS
NO MORE USE FLAGS
YES
END OF PROGRAM
274
278
NO
282
SEND m ADD. OF FIRST FLAG TO PRINT WHEEL ARRAY
SCAN RAM SEQ. FOR STORED CHAR. REPRESENTED ON MOUNTED PRINT WHEEL
286
READ (m,n) CODE OF DETECTED CHAR. OUT OF RAM
290
GEN. X,Y POSITION OF m,n CODE READ
294
298
300
X,Y POSITION OF PRINT HEAD
COMPARE X,Y POSITION OF PRINT HEAD WITH X,Y POSITION OF CHAR.
304
306
TO PRINT HEAD
GEN. ΔX & ΔY
312
310
TO PRINT HEAD
SEND OUT n CODE
316
318
END OF CHAR. PRINT
NO MORE CHAR. CODES FOR MOUNTED WHEEL
NO
YES

AUTOMATIC PRINTER WITH PLURALITY OF REPLACEABLE PRINTING MEMBERS

BACKGROUND OF THE INVENTION

1. Field of the Invention

The present invention is directed to a printer capable of a high speed printing of a large number of characters on a medium and, more particularly, to an automatic printer having a plurality of replaceable character printing members for printing a large quantity of characters, such as the symbols of the Japanese or Chinese language.

2. Description of the Prior Art

As can be appreciated by those versed in the Japanese written language, three forms of writing are frequently utilized. These include a normal written form of a Japanese-like alphabet with approximately 52 characters known as, Hiragana. Supplementing the Hirakana form of printing is another written character system called Katakana which is basically a phonetic forming of words in writing. Finally, a relatively complex and numerous character writing form with a large number of characters is utilized called Kanji. The derivation of the Kanji characters is from China and requires a knowledge of symbols running into the thousands. Each symbol can convey a word or phrase to the reader. Approximately a minimum of 2,000 Kanji characters are required as a vocabulary of written characters for a printer. The Kanji form of writing is preferred in Japan since it has a capability of conveying more complex thoughts and meanings than that of the other writing styles of Katakana and Hiragana. Frequently, a written document will integrate all three styles of writing simply because certain words, such as Western derived words, may have to be formed in Katakana because there is no equivalent Kanji symbol in the Japanese language. As can be appreciated, the net effect of this relatively sophisticated and complex form of writing is to create relatively complex problems in providing an automatic printer.

Japanese character typewriters are known and generally utilize a bed of type font that is individually selected in a panographic manner with a selecting stylus from a table of characters. Chinese, or Kanji, printers must utilize a large number of characters, e.g., approximately2,000, as compared to the alphabetic, or English, character printer. The large number of characters required has necessitated a relatively complicated and expensive mechanism. There have been suggestions to use an impact style printer which employs individual characterers on a character drum. However, problems exist with the use of a character drum relating to the complicated control mechanisms required for a drum containing such a large number of characters. In addition, it is difficult to obtain high printing speed with sufficiently high quality print. To date, there are no known serial Chinese character printers suitable for the commercial market with satisfactory print quality and printing speed. At the present time, a Japanese syllabus is utilized for the printing of Japanese language sentences.

A prior art example of a serial character teleprinter having a plurality of type font units retreivable from a storage receptacle is disclosed in U.S. Pat. No. 3,892,303. Manual and electrical controls are provided wherein the font units can be changed automatically in response to a coded signal defining the desired font unit. An automatic tabular position memory is provided to record the carriage position at the time of initiation of a font unit change so that after the font unit removal and change, the carriage can automatically be returned to the original position along the writing line and printing is resumed. The controller is capable of selectively replacing a font unit to imprint a desired character as the printing line is continually advanced.

A dot-matrix printed utilizing electromagnetic members for driving print wires is suggested in U.S. Pat. No. 3,904,011. Generally, in a dot-matrix method of printing 24 × 24 dots are required to simply obtain a medium quality print. The problem of manufacturing the required number of wire-dots with an appropriate pitch increases the resultant cost of the printer. In addition, the required character memory for an automatic printer is relatively expensive, since 576 bits per character are required.

Electostatic printers are also known and provide an adequate density of dots for the formation of the character. However, there is still the disadvantage of requiring a large character memory and also, it is not possible to produce a carbon copy during the printing. An ink-mist printer and optical printer have also been suggested in the prior art to attain high printing speed. These, however have the same disadvantage of requiring a large character memory and of not being able to produce a carbon copy. A supersonic beam printer is suggested in U.S. Pat. No. 3,907,089 and is cited simply of general interest.

U.S. Pat. No. 3,907,091 is cited simply to disclose a print wheel for a serial printer. U.S. Pat. Nos. 3,913,722; 3,904,015; and 3,890,894 are cited of general interest to disclose additional printed mechanism.

In summary, high quality print has been attained in the prior art with a serial printer which employs a character ball, or character wheel. However, the quantity of characters that can be automatically printed out with an advantageous printing speed is extremely limited. Suggestions have been made to utilize more than one printing head, however, problems occur in the period of time necessary to exchange the print heads. This problem is further compounded when a large number of characters are required, for example, in a Kanji Japanese printer. To date, there are no known serial Kanji printers having a suitable cost for a commercial market with satisfactory printing quality and printing speed. When it is required to print Japanese characters, generally, Hiragana or Katakana must be resorted to and Kanji will only be utilized where necessary with a resulting increase in cost and reduction in sped.

SUMMARY OF THE INVENTION

It is an object of the present invention to provide a serial printer with capability, print quality and cost comparable to that of an alphabetic or Japanese-syllabus printer presently on the market.

The present invention provides a printer assembly for printing a large number of characters on a medium from a plurality of replaceable character printing members. The respective character printing members can, in one embodiment, take the form of a print wheel having a central magnetizable portion. A carriage is provided on the printed for operatively supporting the printing member relative to the medium. The carriage includes an electromagnet for holding the print wheel on the carriage. An exchange mechanism is provided for interchanging a character printing member from the carriage to a storage receptacle, such as a carousel holder. The exchange mechanism can include a pivotable arm with an electromagnet for transporting the character member.

A character memory storage means, which includes a buffer memory, can receive a predetermined quantity of information to be imprinted on a medium, for example in the form of a digital code. A controller is capable of addressing the memory storage for selecting a first character wheel from storage, and further, for activating the exchange mechanism for operatively positioning it on the carriage. The controller coordinates the position of the carriage, medium and the impacting of a hammer to coordinately print a first group of characters from the first character printing member across a predetermined area of the medium. The controller further sequentially activates the exchange mechanism to replace the first character printing member with a second character printing member for further scanning the same predetermined area of the medium to interpolate the printing of a second group of characters. The controller continues to select and print from the printing members until the encoded information is fully printed on the predetermined area of the medium. Advantageously, the initial coding of the characters permits a selection sequence of printing members which minimizes the total printing and scan time across the predetermined area of the medium.

Various forms of character printing members can be utilized, however, in the preferred embodiment the characters are Japanese Kanji, Hiragana and Katakana plus the normal numerical and other characters. The printing members are advantageously print wheels, or discs, which can be stored in a rotatable carousel housing.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

A BRIEF DESCRIPTION OF THE DRAWINGS

FIG. 1 is a simplified schematic of the printer assembly of the present invention;

FIG. 2 is a plan view schematic of the carousel of the present invention;

FIG. 3 is a cross-sectional view of the carousel of the present invention;

FIG. 4 is a side view of the print wheel of the present invention;

FIG. 5 is a plan view of the print wheel of the present invention;

FIG. 10 is a block diagram of the code signal responsive controls of the present invention;

FIG. 11 is an illustrative example of a character input unit;

FIG. 12 is an illustrative example of a format for an output code;

FIG. 13 is an illustrative example of a format code of the stored print wheels suitable for addressing by a controller;

Figure 6:
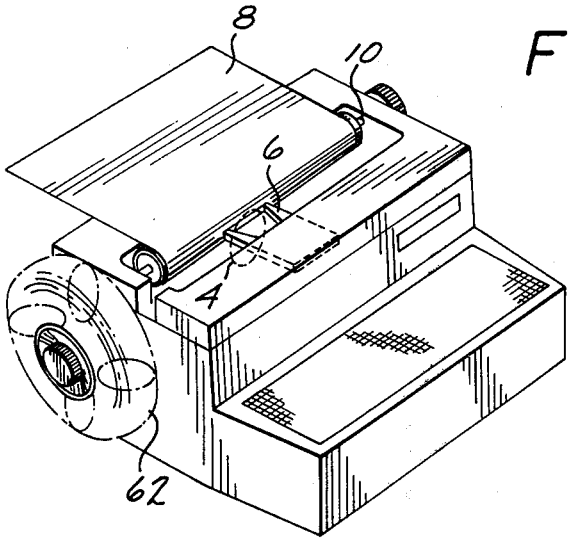
FIG. 6 is a simplified perspective view of the printer of the present invention.

FIG. 14 discloses an illustrative format table for the sequence of print wheels to be used;

FIG. 15 discloses an alternative embodiment of an exchange mechanism for use in the present invention; and FIG. 16 is a controller block diagram.

DESCRIPTION OF THE PREFERRED EMBODIMENT

The following description is provided to enable any person skilled in the teleprinting and computer art to make and use the invention and it sets forth the best modes contemplated by the inventors of carrying out their invention. Various modifications, however, will remain readily apparent to those skilled in the above arts, since the generic principles of the present invention have been defined herein specifically to provide a relatively economical and easily manufactured printer assembly with a descriptive emphasis directed to its use as a printer for the Japanese language.

Reference is made to the U.S. Pat. Nos. 3,554,347, 3,892,303 and 3,484,768 to disclose prior art automatic controls and memories associated with printer mechanisms. The disclosures of the components of these references are incorporated herein by reference to supplement the present disclosure.

Referring to FIG. 1, a schematic view of the printer assembly 2 of the present invention is disclosed. The printer assembly is of a one page printer concept, that is, the printer will proceed to print a portion of a whole page of characters utilizing only a single character printing member, such as a disc, or print wheel, 4. A subsequent interpolated printing of characters on the page will sequentially be accomplished with additional printing members that scan the same area.

The printer wheel 4 is mounted on a carriage 6 that is capable of scanning the print wheel 4 in an operative mode across a predetermined surface area of a medium to receive the characters. A hammer 16 can be enabled to respond to a proper fire signal for striking a font unit 22 on the print wheel 4. The medium can be a web of paper 8 appropriately mounted on a cylindrical platen 10. Since the medium, or paper, is to be moved past the print position for a number of printing passes, or scans, from the top line to the bottom line of the document, it is important that the relative paper position be accurately maintained. In this regard, the cylindrical platen 10 may take the form of a tractor feed, or a spoked wheel engagement with perforations on the edges of the paper 8. This has been schematically illustrated by the disclosure of the teeth 12 on the platen 10. The paper feed mechanism can be rigidly linked to a stepper motor (not shown) with a gear reduction. A stepper motor is a brushless DC motor with a fixed number of steps, or stable positions, per revolution when driven by a sequential excitation of its windings. The prime importance of the paper feed mechanism is that there must be a repeatability of paper position to accommodate numerous printing passes for the proper aligned interpolating of characters.

An appropriate transducer, such as a feedback commutator (not shown), can be utilized to provide a position signal of the paper for the printed controls 14. A paper feed command can be applied in the form of an appropriate bit complemented data word specifying direction and displacement. Direction of movement can be governed by the state of the bit and the amount of vertical displacement can be in specific increments also specified by lower order bits. An appropriate paper feed interlock signal will be issued to inhibit any hammer firing during the paper feed. If the paper 8 has been stepped by the number of increments specified in the paper feed command and status signals are reset, the paper feed interlock signal can be removed and the hammer 16 fire logic can be partially enabled.

The mechanism for ribbon movement, to utilize either half of a two color ribbon, is not shown for purposes of simplification. Controlling the ribbon, whether on a lift or drop movement or for advancement after a print operation, is known in the prior art and need not be detailed here.

The print wheel 4 can be appropriately dimensioned to hold a subjective number of characters per wheel. Advantageously, the print wheel diameter is picked to hold between 46 and 75 characters. The relative size of the print wheel 4 effects the print wheel servo time, and in the preferred embodiment, a 60-character wheel is utilized. The print wheel 4 can be molded from a fiber reinforced plastic and, as seen from FIGS. 4 and 5, comprises a series of radial spokes 18 extending from a central base 20. The characters are positioned on the head, or font unit, 22 of the radial spokes 18. The rear surface of the font units can be appropriately designed to accommodate impact energy. The spokes 18 are relatively flexible and are moved when struck by a hammer 16 on an appropriate fire logic signal. The fonts can be metal coated to increase their service life. A magnetically soft steel sheet 24 is attached to the central base 20 and includes a first initial alignment bore 26 and a second final alignment bore 28.

The appropriate print wheel 4 is attached to the carriage 6 by a permanent magnetic chuck 30 having appropriate alignment pins.

The print wheel motor 32 is a DC servo motor with a position transducer 34. The printer controls 14 can compute the address difference between the present print wheel 4 position and the position of the next character. The print wheel servo is then commanded to rotate clockwise, or counterclockwise, whichever is the shortest route, while the position moved is counted using the feedback from the position transducer 34. An absolute counter can be used to keep track of the print wheel and to issue a print wheel position signal which can be compared with a print servo signal. The particular character address to be processed can be complemented and summed with the current print wheel position in an adder to determine the relative movement and direction of the print wheel 4. The print wheel servo system operates roughly in a time-optimal mode which means full on until the position-velocity state crosses a switch criteria. This can, for example, be accomplished by comparing the changing absolute count with the character position from the memory. The print wheel servo logic then operates to make the position-velocity state follow a certain preselected track trajectory as it approaches the next position. The actual position transducer 34 can be of the known optical type. The optical position transducer is preferred due to its mechanical simplicity, less critical alignment requirement and simpler electronic circuits. Generally, the time required to access to the next position is roughly a square function of the access distance and saturation speed is usually not reached within the parameters of the servo print wheel system.

The carriage 6 is, for the ease of illustration, shown in a schematic form in a lowered exchange position for receiving a print wheel 4 from the storage receptacle 36. In this embodiment, the storage receptacle 36 is disclosed in a carousel configuration and can be mounted beneath the platen 10 and the carriage 6 within the casing of the printer assembly. An alternative arrangement of a carousel storage receptacle is disclosed in FIG. 6. In the embodiment of FIG. 1, the carriage 6 can be lowered away from the cylindrical platen 10 to effectuate an exchange of print wheels with the storage receptacle 36. In the embodiment of FIG. 6, the carriage 6 will assume an exchange position at one end of travel adjacent a side mounted storage receptacle 62.

The carriage drive servo can also be a DC servo drive similar to the print wheel servo mentioned above. The motor drive connection is not disclosed in FIG. 1, but the use of a cable drive is known in the prior art and can be advantageously utilized in the present invention.

The carriage servo circuit will be somewhat similar to that of the print wheel servo circuit except for the difference in the register control. A carriage logic command can specify the direction and length of a move and the logic will decrement the difference address register by one for each increment of motion. With the subsequent print wheels printing their characters by interpolation with the preceeding printed characters, it is possible for the carriage logic to determine the shortest path and then either decrement, or increment, the carriage address counter until the address counter is equal to the command register and the difference register is equal to zero for that specific print line. During the movement of the carriage, a carriage interlock signal is utilized to inhibit the print hammer 16 while the carriage is being moved. As is known in the prior art, the velocity of the carriage can be appropriately varied with velocity control signals controlled by the contents of the difference register. The carriage command signals can be applied in the form of a complemented bit data word to specify direction and lateral displacement with the direction of the movement governed by the state of the first bit. The positional movement can be specified by the lower order bits. The printer controls 14 will maintain a record of the character position and will limit the magnitude of the carriage command to the available space. The carriage logic will tend to simplify every movement commanded, and accordingly, the printer controls will continually provide a print status of the characters employed in the earlier print wheels to insure that the minimum carriage movement is necessary to complete a single scan of the medium area to be covered. It should be noted that in an effort to conserve time, servo motors can be used instead of stepper motors to permit an increase in speed, for example, when only a few characters remaining are to be interpolated on the medium.

The hammer 16 is driven by a solenoid 42. The solenoid 42 is capable of generating sufficient force to accelerate the hammer 16 so that the energy of the hammer 16 when impacting the font head 22 is sufficient to cause an evenly dense image on the original, as well as, the copies. The actual print energy required will be a function of the size and complexity of the character, the ribbon used, the number of copies, and the platen material. As can be appreciated, the use of Kanji characters can require a considerable amount of impact energy.

The storage receptacle 36 can take the form of a ring-like carousel member than can be manually removed from the printer assembly 2. FIG. 3 discloses a cross-sectional view of the carousel storage receptacle. The upper portion of the storage receptacle includes a handle 44 to facilitate insertion and removal on the printer assembly 2. Basically, the storage receptacle 36 will include an outer casing 46 supporting through appropriate bearings an inner rotatable support member 48. The center of the support member is adapted to receive a stepper motor 50 for driving and indexing through an appropriate gear reduction (not shown). It is possible to use the same stepper motor of the carousel drive that will be used for the exchange mechanism, thus, the exchange stepper motor 38 can be utilized with the position transducer 40. Since the carousel drive will be dynamically less demanding than the exchange arm drive, it is also possible to connect the carousel directly to the stepper motor 38 without a slip clutch (not shown). The support member 48 consists of a central hub with radial arms, or spacers, 52 extending outward and supporting permanent magnetic chucks 54. Additional spacers 56 can also be utilized on a cover to prevent the individual print wheels from accidentally coming loose from the magnetic chucks 54 in storage.

Referring to FIG. 2, a schematic plan view of an exposed support member 48 with radial arms 52 is shown for a 37 print wheel embodiment. The carousel drive can be activated to position the appropriate print wheel in an exchange position relative to the exchange arm 76.

Referring again to FIG. 1, a position transducer 58 can be coordinated with the printer controls 14 to accurately maintain a coordination of the desired print wheels as they are utilized in sequence. The printer controls 14 can be capable of addressing the memory 60 to select the print wheel having the largest number of characters to be utilized on the predetermined area of the medium. Sequential selecting of print wheels will be on the basis of the largest remaining number of characters to be printed in order to maximize the shortest printing time. It is also possible to simply align the storage position of the print wheels, depending on a statistical usage rate, that is the most commonly used character being mounted on the first print wheel with secondary characters mounted in sequences of usage on the remaining print wheels.

Referring to FIG. 6, the preferred mounting of a carousel storage receptacle 62 is disclosed. While not shown, the carousel 62 is appropriately indexed to insure a proper mounting on the shaft of the motor 50.

Figure 7:
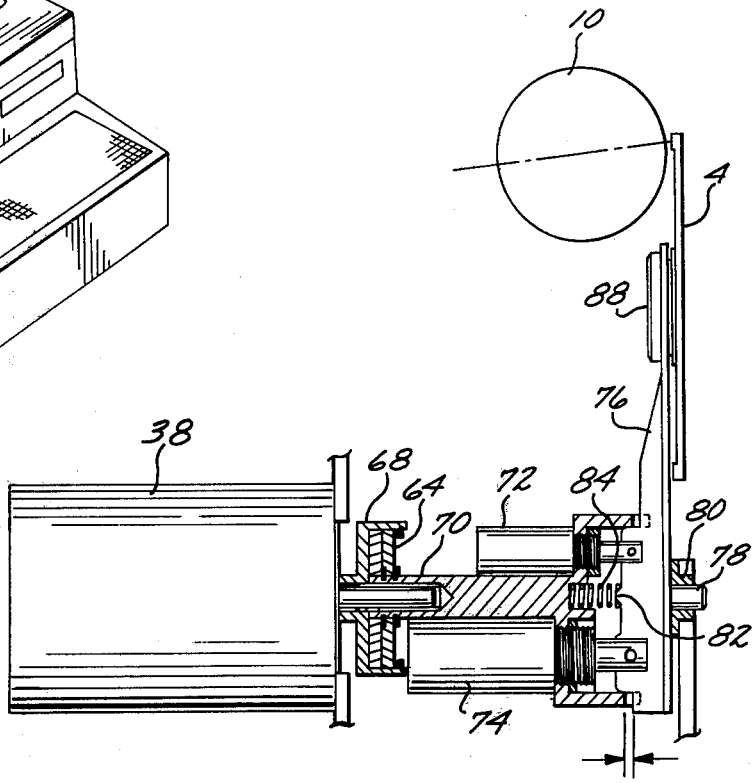
FIG. 7 is a schematic side view of the exchange mechanism of the present invention.

Referring to FIG. 7, a partial side cross-sectional view of the exchange mechanism of the present invention is disclosed. The relative position of the carousel storage receptacle determines the range of movement required of the exchange mechanism. The exchange stepper motor 38 can be controlled through a ramping control (not shown) to overcome the large inertia presented to the motor 38. A slip clutch 64 is schematically shown interconnecting a bifurcated shaft member 68 with a shaft lever 70. The shaft lever 70 mounts a first solenoid 72 and a second solenoid 74 that are respectively connected to the exchange arm 76. The exchange arm 76 is pivotally mounted via a shaft 78 in an appropriate bearing 80.

Figure 8:
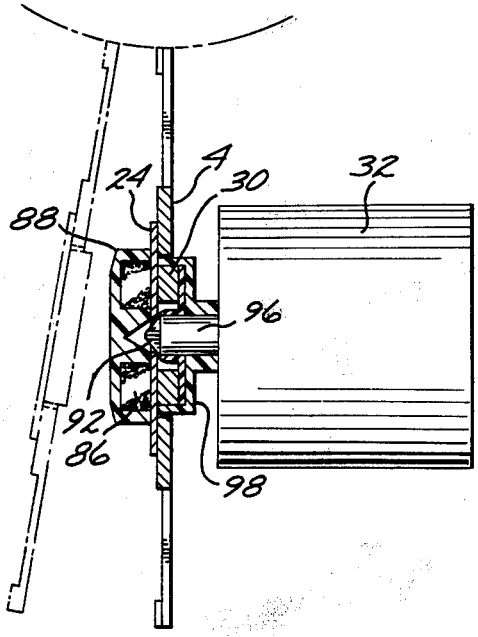
FIG. 8 is a schematic cross-sectional view of a portion of the carriage of the present invention.

A pivot hub 82 extends intermediate of the connections between the first and second solenoids and mounts a compression spring 84. At the other end of the exchange arm 76, a magnetic coil 86, best seen in FIG. 8, is mounted within the housing 88. The coil 86 can be selectively energized to create an appropriate magnetic field. In operation, the exchange arm can receive an appropriate signal from the printer control 14 for rotation of the arm 76 adjacent a print wheel 4 mounted on the print wheel motor 32. Both of the first and second solenoids will be activated to bring the magnetic coil 86 into contact with the central steel sheet attachment 24 of print wheel 4. The first solenoid 72 is activated to rotate the exchange arm 76 about the pivot hub 82 to provide a mechanical leverage for breaking the magnetic force between the permanent magnetic chuck 30 and the steel sheet 24 of the print wheel 4. The second solenoid 74 is then activated to complete the retraction of the print wheel 4 from the carriage magnetic chuck 30. Subsequent rotation of the exchange arm 76 under control of the printer control 14 will place the print wheel 4 in its appropriate indexed position within the carousel storage receptacle 36. The initial alignment bore 26 and the final alignment bore 28 must be aligned with appropriate pins to insure proper indexing of the print wheel 4 in the carousel receptacle 36.

Referring to FIG. 1, the phantom lines of the exchange arm 76 discloses the position of the exchange arm in the storage receptacle 36. The appropriate movement of the first and second solenoid 72 and 74 can once again engage the exchange arm 76 with another printing wheel for removal from the storage magnetic chuck 54 in a manner similar to the removal from the permanent magnetic chuck 30 on the print wheel motor 32.

Referring to the plan cross-sectional view of FIG. 8, the print wheel motor 32 is disclosed supporting a print wheel 4 with the exchange arm 76 attached through the magnetic coils 86 to the print wheel central steel sheet 24. The magnetic chuck 30 can comprise a ring-shaped ceramic magnet capable of generating a four pound force for holding the print wheel 4. The print wheel 4 can be registered by a protruding rough alignment pin 92. In FIG. 8, the location of the next print wheel in the carousel storage receptacle 36 can be seen in phantom lines. Because the print wheel 4 will be designed of plastic, its rotational inertia will be relatively small, and thus, the response of the print wheel servo system can be quite fast, for example, in the range of 25 milliseconds.

Figure 9:
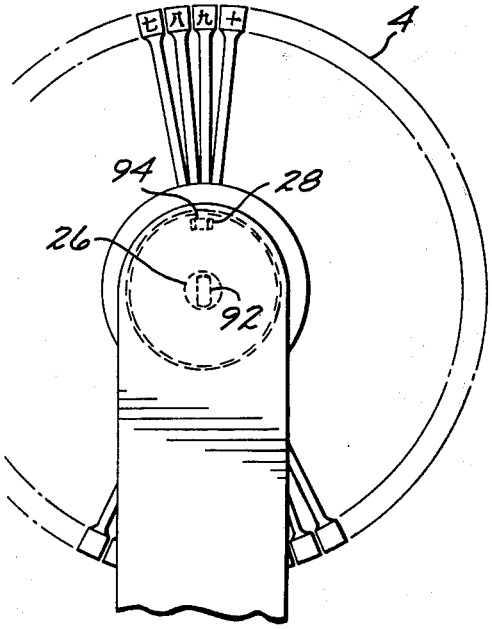
FIG. 9 is a plan view of the exchange arm and print wheel of the present invention.

Referring to FIG. 9, the relative position of the alignment bores 26 and 28 and the alignment pins 92 and 94, can be seen. Advantageously, the alignment pin 92 can be part of the shaft 96 of the print wheel motor 32. The hub 98 mounted on the motor shaft 96, not only supports the magnetic chuck 30, but its rim helps maintain a flat position of the plate of the print wheel. Generally, the electromagnetic coil 86 will be capable of creating twice the magnetic flux of the permanent magnet 30.

With reference to FIG. 15, a perspective view of an alternative electromechanical linkage system for activating the exchange arm 76 is disclosed. A reversing motor 71 has a slotted cam 73 and a crank arm 75 mounted on its output shaft 77. A follower 79 is pivotally mounted and attached to a lower shaft 81 connected to the exchange arm 76. Mounted on the lower shaft 81 is an elongated gear 83 that can slidingly intermesh with a Geneva indexing gear 85.

Cam 73 can be proportionately slotted to magnify the motor torque sufficiently to overcome the permanent magnetic force that is holding the print wheel 4 on the carriage magnetic chuck 30. Thus, by rotation of the output shaft 77 by the reversing motor 71, the follower 79 can move the lower shaft 81 and the attached transfer arm 76 perpendicular to a mounted print wheel. Further rotation will operatively engage the crank arm 75 with the slot 87 of the Geneva gear 85. Rotation of the Geneva gear 85 will rotate exchange arm 76 for the appropriate movement of the print wheel between the storage position and the carriage. As can be appreciated, the rotation of the crank arm 75 must be reversed to insure alignment with slot 87 of the Geneva gear 85 for movement of the print wheel in the opposite direction.

Other forms of electromechanical linkage systems can be utilized to provide the desired retraction and rotation of the exchange arm 76, and accordingly, the present invention should not be limited to the two embodiments disclosed above.

The characters carried by the print wheels, of course, can be subjectively determined. However, in the present application illustrated as the preferred embodiment, approximately 2,160 characters will be stored on 37 print wheels. Generally, 75 Hiragana characters will be utilized, 75 Katakana, 20 numbers, an alphabet of 52, 36 various symbols, and 1,878 Kanji characters. Usually, an auxiliary wheel is included and can be subjectively personalized for the needs of the particular owner of the printer. The arrangement of the characters on the print wheels can be derived on the basis of statistical usage. That is, those characters that are more frequently used will be placed on the first print wheel with subsequent less used characters placed on subsequent wheels. In this regard, it is possible to produce the maximum printing with the first print wheel and to minimize the printing time with the subsequent print wheels. As can be appreciated, a whole carousel storage receptacle can be interchanged with the inventive printer.

Referring to FIG. 10, a controller block diagram is schematically illustrated. The controller unit of this printer assembly 2, is generally illustrated in FIG. 10, and comprises a central processing unit 100 which can be any of the known 8-bit microprocessors, for example, with an execution time of 2 microseconds. The microprocessor is connected to a read only memory (ROM) 104 which can be thought of as divided into two sections 108 and 110. Section 108 stores the program for the CPU and section 110 stores a transform code table. The CPU also interfaces with a random access memory (RAM) 102 which can also be thought of as comprising two major sections 106 and 112. Section 112 stores the character codes received by the CPU which make up a complete display sheet, or window frame. Section 106 is utilized partly as a temporary store and also includes a table that indicates which of the multiple print wheels of the print mechanism are to be used for printing the characters stored in section 112 of RAM 102.

Section 106 can be composed of working addresses from 0 to 255 as shown in FIG. 14. Addresses over 256 can be used for a storage text. Section 110 can be composed of addresses 0 to 2,047 to store the entire program, which controls the entire printing operation. Section 112 can be composed of addresses 2,048 to 6,368 and can be used for the tables to transform the input digital codes.

The CPU 100 interfaces with the outside world through interface circuitry, which is well known and will not be further described herein except in a general way. The interface circuit 171 receives an end of print signal from the print mechanism on line 711 and supplies it to the CPU 100. Interface circuit 172 receives signals on line 721 from the print head mechanism that indicates the $x$, $y$ orientation of the print head with respect to the platen 10. Output interface circuit 173 receives information from the CPU 100 which directs the positioning of the print head with respect to the platen 10 by signals supplied to the print head motor on lines 732 and 733. These position signals indicate changes in the $x$, $y$ orientation of the print head mechanism. The signal on line 731, which can be thought of as the print wheel selection signal, selects one of the many print wheels of the printer mechanism to be loaded on the print head. The signal on line 734, which can be thought of as the character selection signal, identifies which of the characters on the particular print wheel is to be printed at a particular moment.

Interface circuit 174 is actually a text interface with an $x$, $y$ character code source, such as a keyboard, for example. The interface circuit 174 receives on line 741 the $x$, $y$ character code as it is generated by an operator utilizing the keyboard, as shown in FIG. 11. FIG. 11 is a schematic storage matrix which is capable of holding 2,160 characters in the form of 30 rows and 72 columns. When an operator selects a particular character, the corresponding coordinates are sent out in the form of a preassigned code. These character codes are stored in section 112 of RAM 102 in the sequence that they are received. It will be remembered that section 112 of RAM 102 stores the character codes that are to be printed on a particular cage, or window. The character code may take the form illustrated in FIG. 12 wherein a multibit word is divided into an $x$, $y$ section. The particular word format shown in FIG. 12 consists of 12-bits, or two sections, one section containing 7-bits, and the other containing 5-bits. Up to 1,500 character codes can be stored in RAM 102 which can include incidental codes, such as resetting new lines and miscellaneous non-print functions. Since the CPU 100 is an 8-bit parallel processor, it will receive a 12-bit word and store it in RAM as a 7-bit word and a 5-bit word, using two clock times to effect storage. The CPU 100 can take codes from addresses 256 and 257 in RAM 108, which will, accordingly, correspond to the first character codes and will process the following address calculation:

$$A = 2\,(72y + x) + 2{,}048$$

The addresses, such as $m$ and $n$, can be represented by the format shown in FIG. 13 and are stored in ROM 104.

Reference is now made to FIG. 16, which illustrates the functional flow as directed by the central processing unit 100 in order to generate, at the appropriate times, the control signals on line 731 through 734 which are supplied to the print mechanism. Before printing, an initial condition must be set, that is, the carriage means must present the print motor 32 to an initial alignment position for interacting with the exchange arm 76 and the necessary registers must be reset.

Before the CPU can do anything, it must first be in receipt of $x$, $y$ character codes 220 that are received from an outside source, such as a keyboard, or other well known character code sources. If the system is enabled 222, the CPU will respond by sequentially storing 228 the $x$, $y$ character codes are simply piled up at the interface. Upon having stored at least two character codes in RAM, the processor will proceed, in between the time it is storing 228 the $x$, $y$ character codes in RAM to remove, in a sequential manner, 232 the codes stored in RAM starting with the first such $x$, $y$ character code stored.

As each such character code is removed from RAM, its RAM address is saved 238 and a ROM address is calculated 254.

This calculated ROM address is used to address 258 ROM character code table of ROM section 108. As each such converted $x$, $y$ character code address as ROM section 108, which is the $m$, $n$ character code table, the corresponding $m$, $n$ character code is removed 262 from the ROM. As each such $m$, $n$ character code is removed from ROM 104, it is stored 242 at the address of its corresponding $x$, $y$ character code. As each $m$, $n$ character code is being stored 242 in RAM, the $m$ portion of the character code is utilized to address 246 the character wheel table in RAM 102 and write a use flag bit 250 into the bit position addressed. This procedure continues until the entire text in RAM section 112 represents all the data to be printed on a particular page, or window, in the converted 264 $m$, $n$ code.

When that has occurred, the CPU 100 proceeds to scan 270 the character wheel table in RAM section 106 in sequence for the purpose of identifying which character wheel in the table have use flags associated therewith upon the first use flag being detected its $m$ address is identified. This $m$ address identifies a particular print wheel. So the CPU 100 sends 282 this print wheel identifying signal $m$ to the output circuit 173 and from there, over line 731 to the print mechanism to select the print wheel that is to be utilized.

The CPU then proceeds to sequentially scan 286 the RAM memory section 112 for character codes therein which have an identical $m$ portion. An identical $m$ indicia indicates that this character code is on the particular print wheel selected by the above $m$ signal. Upon detecting such a match, the entire $m$, $n$ code is read out 290 of RAM. At the same time, an $x$, $y$ indication of the position of that $m$, $n$ code on the page, or window is generated 294. The $x$, $y$ position of the print head 300 is received by the CPU over lines 721. This $x$, $y$ position code is compared 298 with the $x$, $y$ position code of the character to be printed. A difference $\Delta x$ and $\Delta y$ code is generated 306 and supplied to the print head 304 over lines 732 and 733, respectively. Either sequentially or at the same time, that the $\Delta x$ and $\Delta y$ codes are sent out, the CPU will send out 310 the $n$ portion of the character code, to the print head 312 over line 734, identifying the particular character in the print wheel chosen which is to be printed.

As that character is printed, the CPU receives end of character print signal 318 over line 711 and decides 316 whether there are any more character codes stored in RAM section 112 that correspond, or are located, on the particular print wheel mounted. If there are no more, then the CPU goes back to scanning 270 the character wheel table in section 106 of RAM for the next use flag. If there are more characters, then the CPU continues to scan 286 section 112 of RAM memory for the next character to be printed. This process continues until the entire contents of RAM section 112 are printed on the page. The CPU can detect this condition by noting whether there are any more use flags 274 in the character wheel table. If there are no more, then the processor knows it is the end 278 of its procedure. If there are still more use flage, it will simply continue with steps 282 through 316 until all use flags have been worked on.

As mentioned previously, the characters on the individual print wheels are arranged such that as the value of $m$ increases, the average rate of the characters to be used becomes smaller. Print wheels with a large $m$ value may not be utilized in a normal printing. Even if they are utilized, it will be for a relatively short time since the predetermined medium will be effectively covered with the printed characters.

The calculation time of the CPU is much faster than the servo units, e.g., in the range of 500 microseconds, so that the speed of the servo motors become essentially the printing speed of the printer assembly 2. Since Kanji characters in Japanese can represent a whole word or phrase, it is actually possible for the Kanji printer to approximate the printing speed of a standard printer using the English alphabet. Depending upon the particular location of the carousel storage receptacle 36 and the necessary movement required of the exchange arm 76, the exchanging of the print wheels can be accomplished in approximately one second. The actual printing time of the characters will be somewhat subjective, depending upon the number of print wheels required in any predetermined area of the medium.

As can be appreciated by those skilled in the art, other functional flow directions can be generated for controlling the printer mechanism of the present invention, and accordingly, the scope of the present invention should not be limited by either the specific illustration disclosed in FIG. 16, nor by the specific mechanical embodiments described. The present invention not only provides unique print wheel and exchange mechanisms, but further, provides a unique printer assembly for printing from a large number of characters in an optimum time period by interpolation of secondary characters into a preceding printed first group of characters.

Since various modifications can be accomplished by persons skilled in the art, the scope of the present invention should only be measured from the following claims in which we claim:

1. In a printer assembly for printing a large number of characters on a medium from at least three replaceable character printing members, each character printing member containing a plurality of characters with at least some characters not contained on another printing member, the improvement comprising:

a carriage means for operatively supporting a character printing member relative to the medium;

storage means for holding a plurality of character printing members;

exchange means for returning a character printing member from the carriage means to the storage means and replacing it on the carriage means with another character printing member;

character memory storage means for receiving and storing a predetermined amount and location of characters that are contained on at least three separate printing members including means for designating all of the characters to be printed from each character printing member;

control means for addressing the memory storage means and to select a first printing member and to scan the memory storage means to determine the character and location of all of the characters to be printed from the first printing member;

means for moving the medium relative to the carriage means to provide a predetermined area of the medium for printing;

means for moving the carriage means with an operative first character printing member across the predetermined area of the medium to coordinately and completely print all of the first group of designated characters from the first printing member; and means for sequentially activating the exchange means and control means to replace the first character printing member with a second character printing member for rescanning the previously printed predetermined area of the medium to interpolate the printing of all of a second group of designated characters from the second printing member and to further replace the second character printing member with a third character printing member to interpolate the printing of all of a third group of designated characters from the third printing member of the medium.

2. The invention of claim 1 wherein the printing member is a print wheel.

3. The invention of claim 1 wherein the storage means includes a rotatable carousel for holding the printing members.

4. The invention of claim 1 wherein the printing member is magnetizable and the exchange means includes means for producing an electromagnetic field for removably securing a printing member.

5. The invention of claim 2 wherein the printing wheels are aligned within the storage means sequentially on a character probability usage descending rate.

6. The invention of claim 3 wherein the rotatable carousel is removably mounted adjacent and to the side of the carriage means.

7. The invention of claim 3 further including an outer housing wherein the rotatable carousel is mounted within the housing and beneath the carriage means.

8. The invention of claim 4 wherein the carousel includes a removable cover and a housing with a plurality of magnetic mounting members for respectively holding printing members.

9. The invention of claim 4 wherein the exchange means further includes an exchange arm, means for rotating the exchange arm and means for moving the exchange arm out of the plane of rotation.

10. The invention of claim 4 wherein the exchange means further includes an exchange arm, means for rotating the exchange arm and a geneva indexing gear for operatively connecting the exchange arm to the means for rotation for limited rotational movement.

11. The invention of claim 5 wherein the control means further selectively positions the storage means to permit the exchange means to replace the first character printing member with the second character printing member of a lower probability usage rate.

12. The invention of claim 9 wherein the means for moving the exchange arm includes a first and second solenoid connected to the exchange arm and a resilient pivot mounting connected to the exchange arm between the connections of the first and second solenoids whereby the first and second solenoids can be activated to move the exchange arm about the pivot mounting.

13. The invention of claim 10 wherein the means for rotation further includes a cam and a pivotable follower, the follower operatively connected to the exchange arm and the cam for providing a relative movement of the exchange arm out of the plane of rotational movement.

14. A printing assembly for printing a large number of characters on a medium comprising:

a plurality of replaceable character printing members, each character printing member containing at least some characters on its periphery not contained on another printing member, at least a central portion of each printing member being magnetizable;

a carriage member for operatively supporting a character printing member relative to the medium including a magnetic chuck for attachment to the central portion of a printing member;

storage means for holding a plurality of character printing members;

magnetic exchange means for magnetically securing a printing member to return one printing member to the storage means and replacing it on the carriage member with another;

means for controlling the exchange means including means for varying the magnetic force between the magnetic exchange means and the printing members for insertion and removal of printing members on the magnetic chuck; and means for moving the carriage member and selectively impacting the printing member against the medium.

15. A printer assembly for printing a large number of characters on a medium from at least three replaceable character printing members, each character printing member containing characters not contained on another printing member, comprising:

a carriage means for operatively supporting a character printing member relative to the medium;

storage means for holding a plurality of character printing members in a predetermined sequence based on the highest character usage probability rate with the highest character usage printing member being positioned first in the storage means;

exchange means for returning a first character printing member from the carriage means to the storage means and replacing it on the carriage means with a second character printing member of a lower character usage probability rate;

character memory storage means for indexing and storing a predetermined amount and location of characters;

control means for addressing the memory storage means to select the first printing member with the highest character usage probability rate;

means for controlling the exchange means to position the first printing member on the carriage means;

means for scanning the memory storage to select the designated character and print location on a printing member;

means for moving the carriage member and selectively impacting the printing member against the medium to coordinately print all of the first group of designated characters from the first printing member on a predetermined area; and means for sequentially activating the exchange means to replace the first character printing member with the next highest character usage probability rate printing member, that has indexed characters to be printed, and rescanning the predetermined area of the medium to interpolate the printing of all of a second group of designated characters.

* * * * *